US005611196A

United States Patent [19]

Wilson

[11] Patent Number: 5,611,196

[45] Date of Patent: Mar. 18, 1997

[54] FUEL/AIR MIXING DEVICE FOR GAS TURBINE COMBUSTOR

[75] Inventor: Andrew J. W. Wilson, Kongsberg, Norway

[73] Assignee: Ulstein Turbine AS, Norway

[21] Appl. No.: 533,651

[22] Filed: Sep. 25, 1995

[30] Foreign Application Priority Data

Oct. 14, 1994 [NO] Norway ..... 943918

[51] Int. Cl.[6] ..... F02C 7/00

[52] U.S. Cl. ..... 60/39.11; 60/737

[58] Field of Search ..... 60/39.11, 39.826, 60/732, 733, 737, 738, 749; 431/329, 350

[56] References Cited

U.S. PATENT DOCUMENTS

| | | | |
|---|---|---|---|
| 2,777,508 | 1/1957 | Jurisich | 60/39.826 |
| 2,806,356 | 9/1957 | Bocchio | 60/749 |
| 4,192,139 | 3/1980 | Buchheim | 60/39.826 |
| 4,457,704 | 7/1984 | Sommers et al. | 431/350 |

FOREIGN PATENT DOCUMENTS 0445652 9/1991 European Pat. Off. .

OTHER PUBLICATIONS

"Handbook of Hydraulic Resistance" (2nd Ed.), I. E. Idelchik, Chapter Four, Flow Through Orifices With Sudden Change In Velocity And Flow Area, p. 145.

"Gas Turbine Combustion", Arthur H. Lefebvre, pp. 114–123.

*Primary Examiner*—Louis J. Casaregola

*Attorney, Agent, or Firm*—Finnegan, Henderson, Farabow, Garrett & Dunner, L.L.P.

[57] ABSTRACT

A fuel/air mixing device for two-stage, lean-flow, pre-mix combustion chambers in gas turbines. The primary and secondary combustors are formed as venturi nozzles with the primary venturi mounted tangentially to a flametube which surrounds the secondary venturi. A perforated cone is provided at the free end of the secondary venturi for the penetration of the fuel-air mixture into the primary flame.

6 Claims, 2 Drawing Sheets

FUEL/AIR MIXING DEVICE FOR GAS TURBINE COMBUSTOR

This invention relates to a fuel/air mixing device for two stage combustion chambers in gas turbines with a primary combustor and a secondary combustor, where in the first stage fuel is introduced to the primary combustor, and in the second stage, at increasing load, more fuel is fed to the secondary combustor, until at full load the fuel/air ratio in both combustors is the same, where primary and secondary combustors are formed as venturi nozzles and the primary venturi is mounted tangentially to a flametube, which surrounds the secondary venturi.

BACKGROUND OF THE INVENTION

The combustion chamber is a lean pre-mix, two-stage design concept with a lean fuel/air mixture in both stages, so that the lowest possible level of pollution is achieved, for all engine conditions from idle to full load.

In order to minimize pollution (NOx) it is important to ensure a fully vaporized and uniform mixture of air and fuel. This is achieved by the use of a venturi nozzle, which ensures a velocity difference between the fuel drops and the air, due to the inertia of the fuel.

Previously, a swirler was used to introduce the secondary fuel/air mixture into the primary flame. This gave the mixture an angular momentum at exit to the venturi, which counteracted the rotation from the primary flame and forced the heavier unburnt mixture outwards due to the effect of centrifugal force. The swirler was costly to produce, had mechanical problems with attachment, showed a tendency to produce unacceptable pulsations, and was vulnerable to burn-out.

EP application 445 652 describes a device for combustion chambers of gas turbines with transverse mixing tubes to a central mixing tube, where the mixing tubes resemble venturi nozzles and where the secondary venturi has a swirler.

SUMMARY OF THE INVENTION

The object of this invention is to produce a fuel/air mixing device which avoids the above problems and which reduces the level of the pollutants CO and $NO_x$ and which has a longer life.

This is achieved by special arrangement of the aforementioned secondary venturi and which is characterised by the particulars and advantages given in the claims herewith.

This invention is a simple air/fuel mixing device for gas turbine combustion chambers, which ensures an improved penetration of the air/fuel mix into a hot gas stream, while presenting a reduced danger for flame-holding and burn-out.

The invention is formed such that design requirements relating to ruggedness, cost effectiveness and mechanical integrity for fuel/air mixing devices are satisfied. It also provides a powerful, stable ejection of a cold fuel/air mixture into a hot gas stream thus avoiding unacceptable pressure pulsation levels.

The scope of this invention also ensures sufficient cooling by the ejection of a relatively cold fuel/air mixture with high velocity into the combustion chamber.

To achieve the objects and in accordance with the purpose of the invention, as embodied and broadly described herein, the fuel/air mixing device for combustion chambers in gas turbines comprises a primary venturi and a secondary venturi, a flametube which surrounds the secondary venturi, the primary venturi mounted tangentially to the flametube, the secondary venturi having a free end and a conical end piece with perforated walls, the conical end piece formed on the free end of the secondary venturi.

BRIEF DESCRIPTION OF THE DRAWINGS

By way of example the accompanying drawings illustrate the invention and its application, and show the following.

DESCRIPTION OF THE PREFERRED EMBODIMENT

Figure 1:
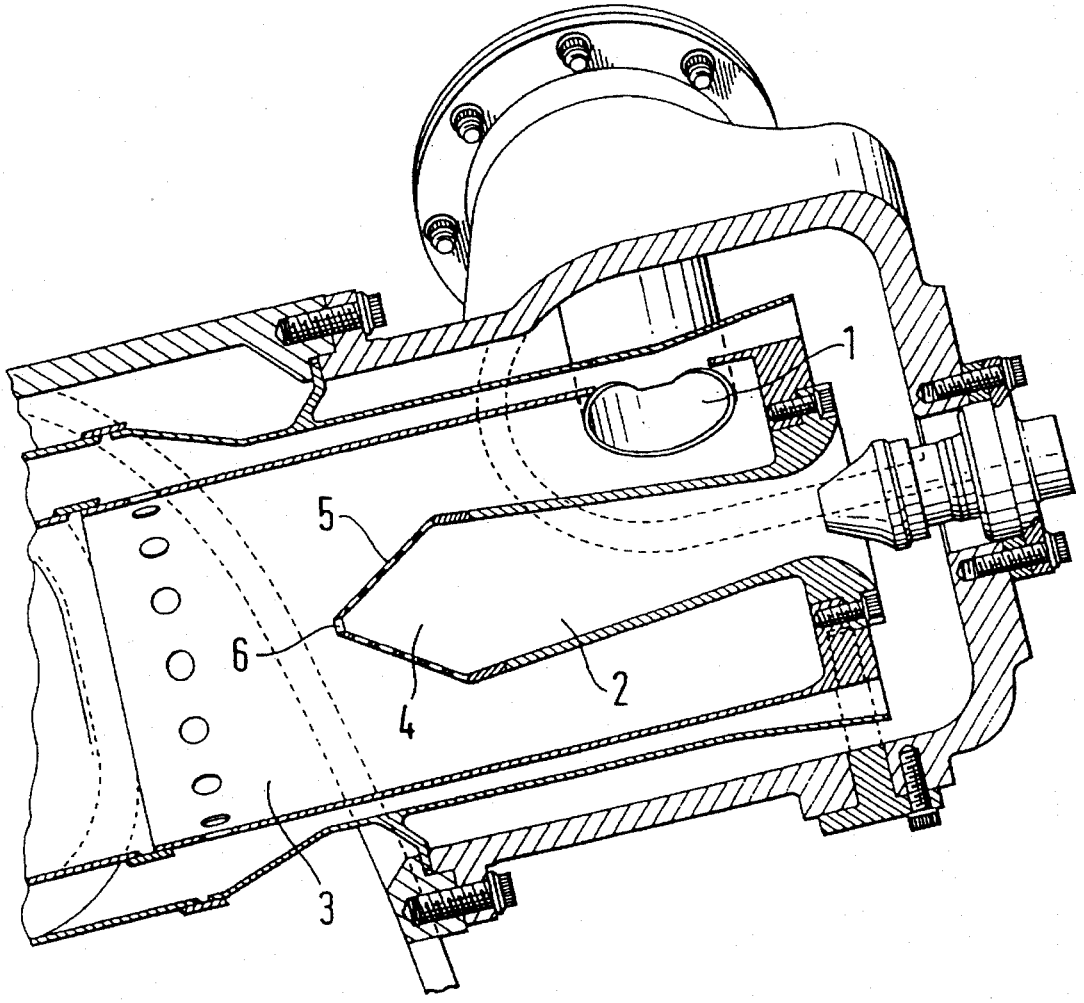
FIG. 1 is a plan view of a primary venturi, which in accordance with this invention is for the ejection of the primary fuel/air mixture into the combustion zone, and a secondary venturi, which in accordance with this invention is placed inside the cylindrical combustion chamber.

FIG. 1 shows in particular a primary combustion chamber 1 connected tangentially to a flametube 3, which surrounds having a closed end piece a secondary venturi 2.

Figure 2:
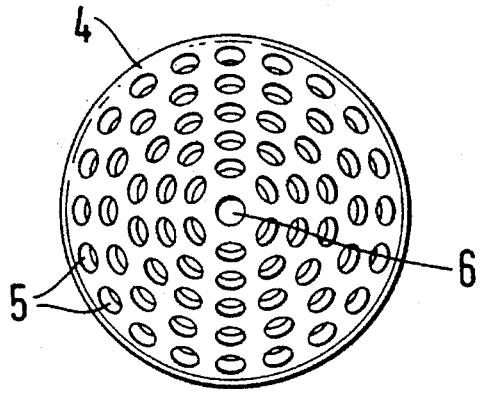
FIG. 2 is a front view of a fuel/air mixing device, which in in accordance with this invention is attached to the free end of the secondary venturi.
Figure 3:
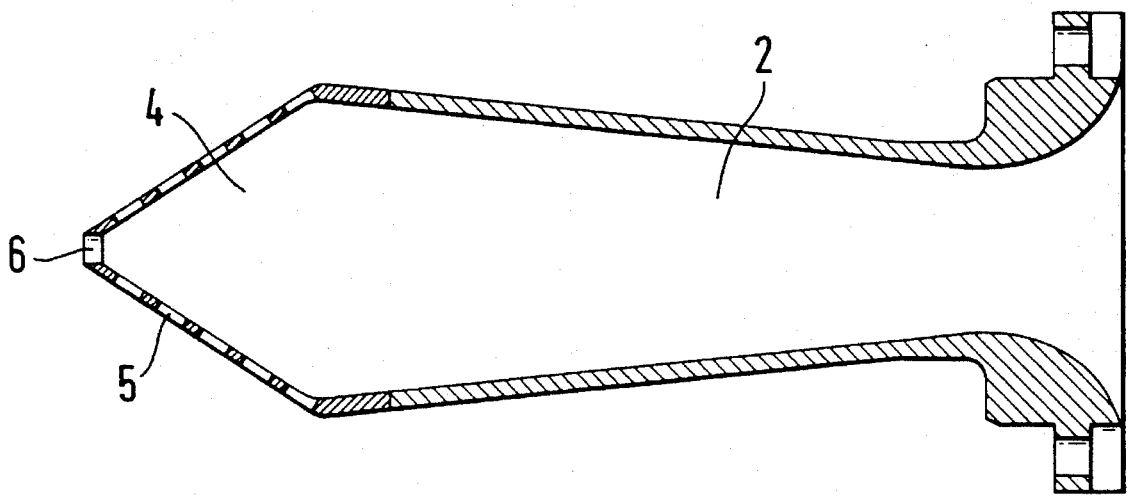
FIG. 3 is a cross section of the device in FIG. 2 and the secondary venturi, of FIG. 1.

FIG. 2 illustrates in particular a closed end piece of FIGS. 1 and 3 with perforated walls 5, attached to the free end of the secondary venturi. The closed end piece 5 is in the form of a perforated cone, which extends from the venturi nozzle and where the perforations or holes 5 are distributed arbitrarily over the whole surface, and where the apex of the cone is placed centrally in relation to the secondary venturi. There is, in addition, at the apex of the cone, a hole 6 for the ejection of the fuel/air mixture in an axial direction. The size of this hole is determined by the required cooling effect.

The number and size of the holes 5, i.e. the total flow area, is determined by the required mass flow of fuel/air mixture in the secondary venturi, the pressure drop available and a coefficient of discharge for the holes 5. This coefficient has been verified experimentally and agrees with well established and publically available theory. Ref. "Gas Turbine Combustion" by A. H. LeFebre and "Handbook of Hydraulic Resistance" by I. E. Idelchik. The number and positioning of the holes as shown in FIG. 2 is meant only as an example and not limitation, the exact values depending upon application.

The cone 4 is cooled internally by the passage of cold fuel/air mixture and the ejection of high velocity mixture through the holes 5. The positioning of the holes 5 is determined by the cooling requirements of the secondary venturi 2. The length of the cone is a compromise between radial penetration and the total combustion chamber length. Lengthening of the cone 4 will lead to less space for secondary combustion and therefore more CO.

As mentioned earlier the number of holes 5 is determined by the required penetration depth into the hot gas stream. The required penetration in the example is to the flametube 3. The hole diameter for the required penetration distance has been calculated by well established and publically available material and has been verified experimentally.

As mentioned in the introduction combustor pulsations are a problem inherent in many lean pre-mix combustor designs. In accordance with the present invention this problem is dramatically reduced compared to conventional designs by the provision of strong high velocity jets of fuel/air mixture into the flametube. In accordance with the present invention, and combustor pulsations being no problem, the fuel distribution between combustor stages can be optimized to minimize pollution and not combustor pulsations.

I claim:

1. A fuel/air mixing device for combustion chambers in gas turbines comprising a primary venturi and a secondary venturi a flametube which surrounds the secondary venturi, said primary venturei mounted tangentially to said flametube, said secondary venturi having a free end and a conical end piece with perforated walls, said conical end piece formed on the free end of the secondary venturi.

2. A fuel/air mixing device of claim 1, wherein the conical end piece is formed as a perforated cone having holes distributed over a surface and the cone having an apex placed centrally in relation to the secondary venturi.

3. A fuel/air mixing device of claim 2 having a central hole placed at the apex of the cone.

4. A fuel/air mixing device of claim 2, wherein the holes are arranged arbitrarily.

5. A fuel/air mixing device of claim 2, wherein the number and size of the holes are calculated on the basis of the required mass flow and pressure drop available, together with the maximum cooling effect.

6. A fuel/air mixing device of claim 1, wherein the length of the conical end piece is determined by the required radial penetration and the total length of the combustion chamber.

* * * * *